US007500801B2

(12) United States Patent
Chu et al.

(10) Patent No.: US 7,500,801 B2
(45) Date of Patent: Mar. 10, 2009

(54) BRUSHING DEVICE OF A CONTAINER OF LIQUID COSMETICS

(76) Inventors: Ming-Chih Chu, No. 90, Wunhua N. 2nd St., Gueiren Township, Tainan County (TW); Cheng-Yi Wang, No. 7-3, Alley 5, Lane 217, Sec. 3, Jhongsiao E. Rd., Da-an District, Taipei City (TW)

( * ) Notice: Subject to any disclaimer, the term of this patent is extended or adjusted under 35 U.S.C. 154(b) by 0 days.

(21) Appl. No.: 11/979,646

(22) Filed: Nov. 7, 2007

(65) Prior Publication Data

US 2008/0286034 A1 Nov. 20, 2008

(30) Foreign Application Priority Data

May 17, 2007 (TW) ..... 96207982 U

(51) Int. Cl.
*A46B 17/04* (2006.01)

(52) U.S. Cl. ..... 401/262; 401/269

(58) Field of Classification Search ..... 401/262, 401/269, 202, 263, 261; 222/502, 503, 544, 222/547, 556, 557, 562
See application file for complete search history.

(56) References Cited

U.S. PATENT DOCUMENTS 4,739,906 A * 4/1988 LoTurco ..... 222/212
7,281,876 B2 * 10/2007 Kwon ..... 401/265

* cited by examiner

*Primary Examiner*—David J Walczak
(74) *Attorney, Agent, or Firm*—Rosenberg, Klein & Lee

(57) ABSTRACT

A liquid cosmetics container has a brushing device, which includes an applying component joined to a container body, and a clipping component around the applying component; the applying component is positioned over an opening of the container body, and has a passage therein for liquid cosmetics to flow through; the applying component has an applying portion at a tail, which is around a tail end of the passage; the clipping element has an opening end, and two gaps extending through the opening end, therefore the opening end is compressible; the clipping component has two opposing clipping portions on an inner side of the opening end; a cap is used to cover the opening of the container body; the cap has a squeezing portion on an inner side to compress the opening end of the clipping component so as to block the passage of the applying component.

5 Claims, 7 Drawing Sheets

BRUSHING DEVICE OF A CONTAINER OF LIQUID COSMETICS

BACKGROUND OF THE INVENTION

1. Field of the Invention

The present invention relates to an improvement on a brushing device of a container of liquid cosmetics, more particularly one, which includes an applying component, and a clipping component capable of being forced to block a passage of the applying component by means of a cap of the cosmetics container; therefore, the brushing device has a relatively simple structure, and takes less time, labor and cost to manufacture and assemble.

2. Brief Description of the Prior Art

Referring to FIG. 7, a prior liquid lip cosmetics container 6 includes a soft container 61, a blocking member 62, a floating plug 63, a connecting sleeve 64, a lip rubbing component 65, and a cap 66. The container 61 has outer threads 611 around an opening thereof. The blocking member 62 is secured in the opening of the container 61, and has a holding hole 621 extending through a center thereof, a closing end 622 on a lower end of the holding hole 621, and several through holes 623 on the closing end 622 for the liquid cosmetics to flow through. The floating plug 63 is received in the holding hole 621 of the blocking member 62 in a movable manner, and has a hydraulic room 631 in a bottom portion, and a through hole 632 extending through a center thereof for the liquid cosmetics to flow through. The connecting sleeve 64 has a through hole 641, and an upper end of the floating plug 63 is held in the through hole 641. And, the lip rubbing component 65 is joined to the through hole 641 of the connecting sleeve 64. The cap 66 has inner threads 661 to be threadedly engaged with the outer threads 611 of the container 61. The cap 66 will depress the connecting sleeve 64 as well as the floating plug 63 so as to make the floating plug 63 become closely in touch with the closing end 622 of the blocking member 62 after the cap 66 is positioned over the connecting sleeve 64, and securely joined to the container 61. Thus, the through hole 632 of the floating plug 63 is blocked by the closing end 622, and the liquid cosmetics are prevented from flow out of the container 61 through the through hole 632.

The above liquid lip cosmetics container has a complicate structure, having too many components. Therefore, it takes much time, labor and cost to manufacture and assemble.

SUMMARY OF THE INVENTION

It is a main object of the present invention to provide an improvement on a brushing device of a container of liquid cosmetics, which has a relatively simple structure, and takes relatively little cost, time and labor to manufacture and assemble.

A brushing device according to an embodiment of the present invention includes an applying component joined to a container body, and a clipping component around the applying component. The applying component is positioned over an opening of the container body, and has a passage therein for liquid cosmetics to flow through. The applying component has an applying portion. The clipping element has an opening end, and two gaps extending through the opening end, therefore the opening end is compressible and capable of springing back to an open position. The clipping component has two opposing clipping portions contacting the applying component. Furthermore, a cap is provided to cover the opening of the container body; the cap has a squeezing portion on an inner side, which will compress the opening end of the clipping component so as to block the passage of the applying component after it is put on the container body.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
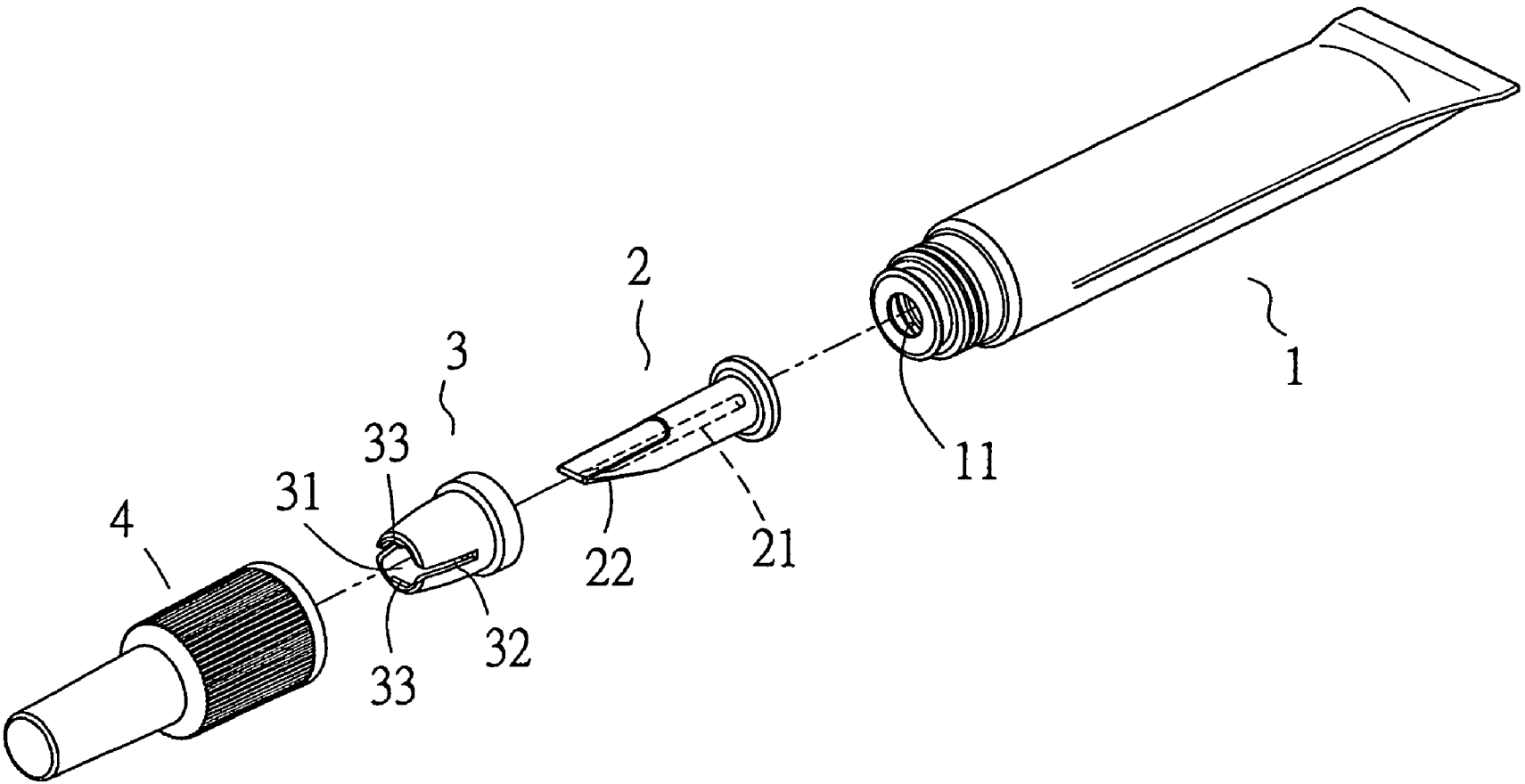
FIG. 1 is an exploded perspective view of the present invention.

Referring to FIG. 1, a first preferred embodiment of a liquid cosmetics container of the present invention includes a container body 1, an applying component 2, a clipping component 3, and a cap 4.

The container body 1 is a squeezable soft container, and used to contain liquid cosmetics. The container body 1 has an opening 11.

Figure 2:
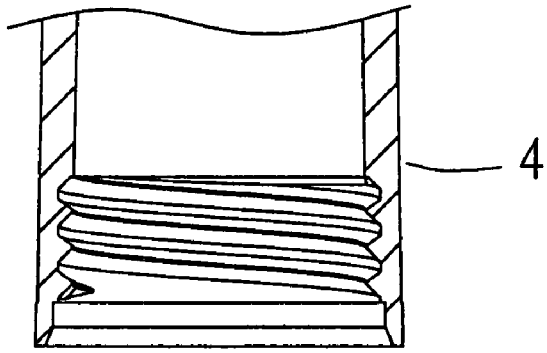
FIG. 2 is a view of the present invention, taken before the cap is put on the container body.
Figure 2:
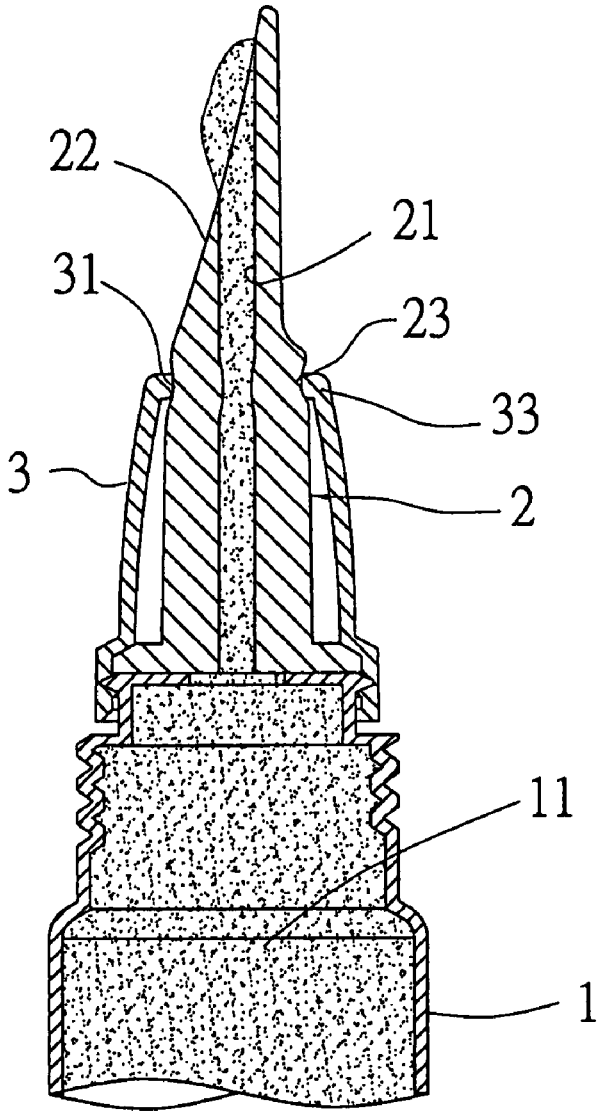
Figure 3:
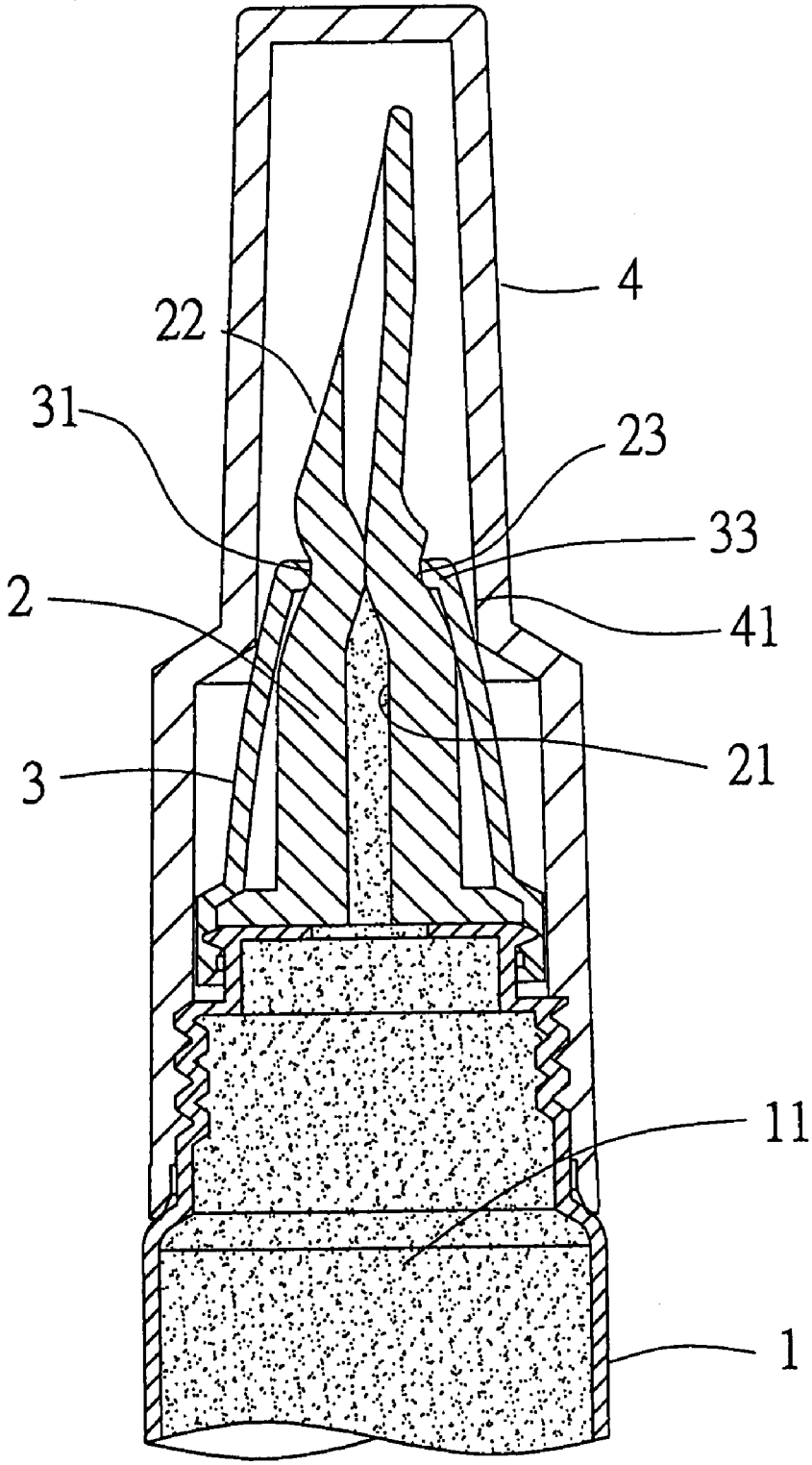
FIG. 3 is a view of the present invention, taken after the cap is put on the container body.

The applying component 2 is secured over the opening of the container body 1. The applying component 2 is made of soft plastic materials such as silicone rubber, and has a passage 21 therein for liquid cosmetics to flow through. The applying component 2 has an applying portion 22 at a tail thereof, which can be formed in any shapes and be around a tail end of the passage 21 to apply liquid cosmetics. Referring to FIGS. 2 and 3, the applying component 2 further has a detainment recess 23 under the applying portion 22 on an outer side thereof.

The clipping component 3 is positioned around the applying component 2, and securely joined to the container body 1. The clipping component 3 has an opening end 31, through which the applying component 2 is passed. The clipping component 3 has two opposing gaps 32, which extend through the opening end 31; thus, the opening end 31 can be compressed, and can spring open owing to elasticity. The clipping component 3 further has two opposing straight clipping portions 33 on an inner side of the opening end 31 thereof. And, the straight clipping portions 33 are clipped in the detainment recess 23 in such a manner as to be closely in touch with the applying component 2.

The cap 4 is put on the opening 11 of the container body 1 to cover the applying component 2 and the clipping component 3. The cap 4 has an annular squeezing portion 41 on an inner side thereof, which will be around the opening end 31 of the clipping component 3 after the cap 4 is put on the container body 1; the inner diameter of the squeezing portion 41 is smaller than the outer diameter of the opening end 31 of the clipping component 3. Therefore, the squeezing portion 41 of the cap 4 will squeeze the opening end 31 of the clipping component 3, reducing the width of the gaps 32, and in turn the clipping portions 33 will clip the applying component 2 so as to block the passage 21 of the applying component 2 after the cap 4 is put on the container body 1.

FIG. 2 shows the cosmetics container in an open state; the cap 4 is separated from the container body 1, and in turn the passage 21 of the applying component 2 is in an open state to allow liquid cosmetics to flow from the container body 1 to the applying portion 22 through it; thus, the user can squeeze out the liquid cosmetics in the container.

Figure 4:
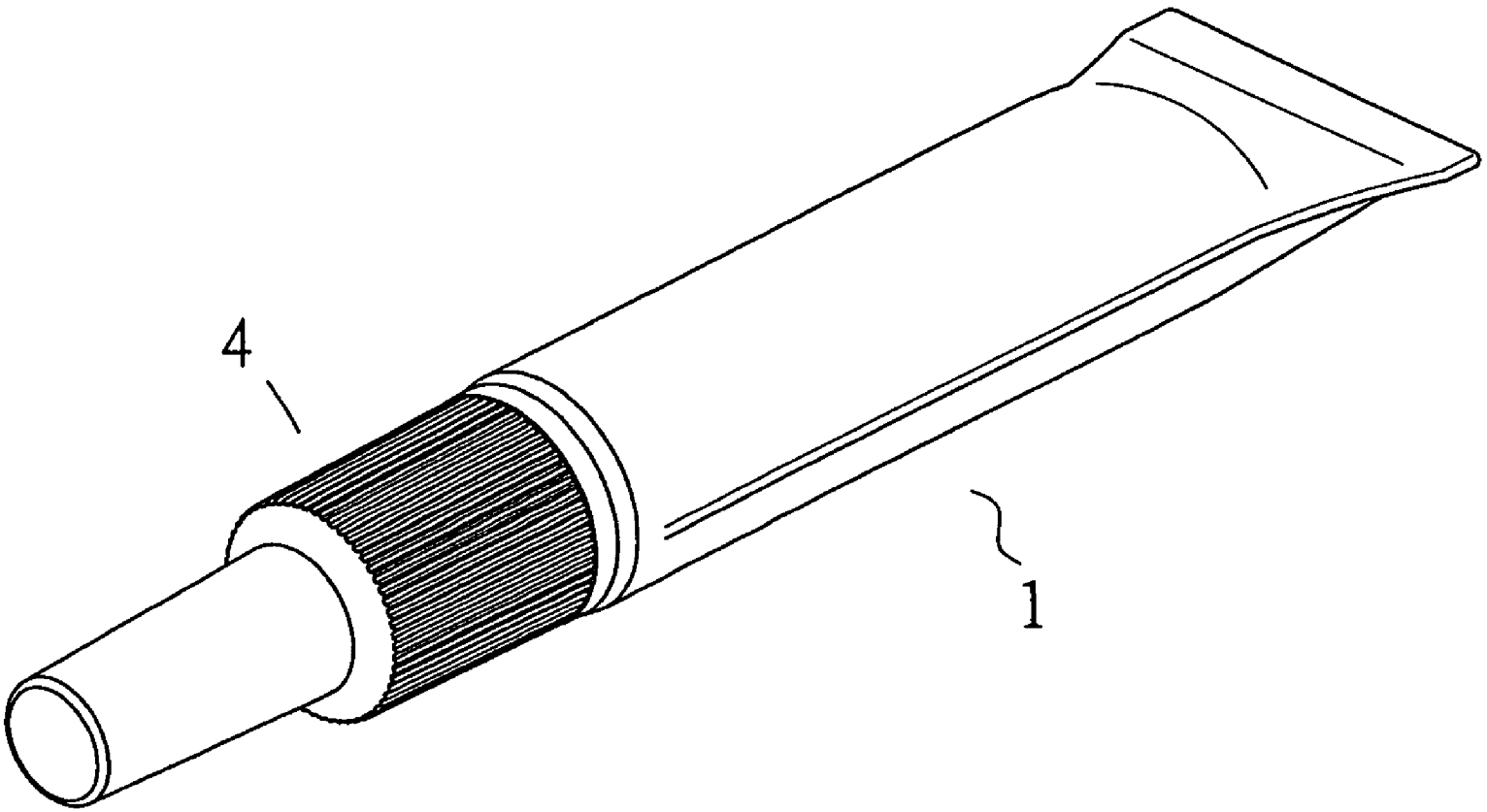
FIG. 4 is a perspective view of the present invention, taken after the cap is put on the container body.

FIGS. 3 and 4 show the liquid cosmetics container in a closed state; the cap 4 is put on the container body 1, and the squeezing portion 41 of the cap 4 squeezes the opening end 31 of the clipping component 3, reducing the width of the gaps 32 of the clipping component 3, and in turn the clipping portions 33 are forced to clip the applying component 2 so as to block the passage 21 of the applying component 2. Therefore, the liquid cosmetics can't flow out through the passage 21.

Figure 5:
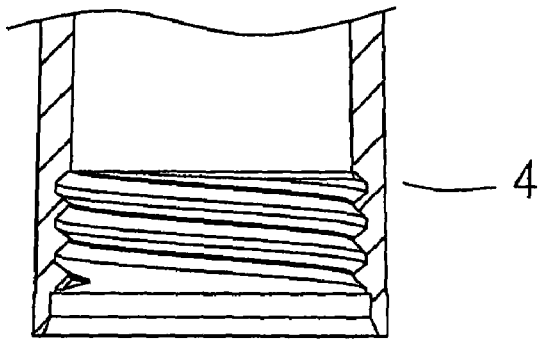
FIG. 5 is a view of second embodiment of the invention
Figure 5:
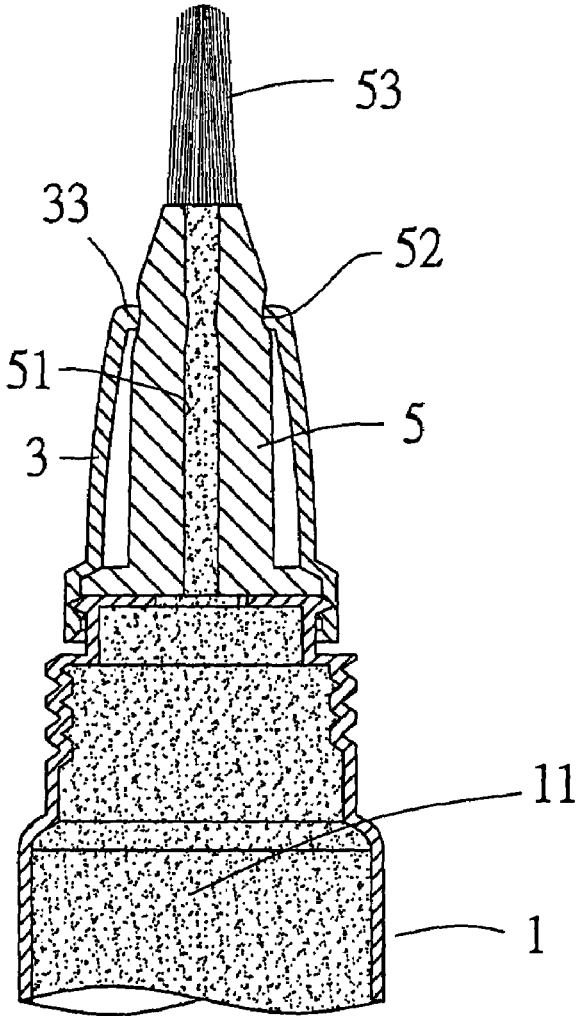

Shown in FIG. 5 is the second preferred embodiment of an applying component 5 of the present invention. The applying component 5 is also made of soft plastic materials, and has a passage 51 for liquid cosmetics, and a detainment recess 52 on an outer side thereof, like the above applying component 2. What makes the second applying component 5 different from the first one 2 is an applying portion 53 of the component 5, which includes brushing bristles.

Figure 6:
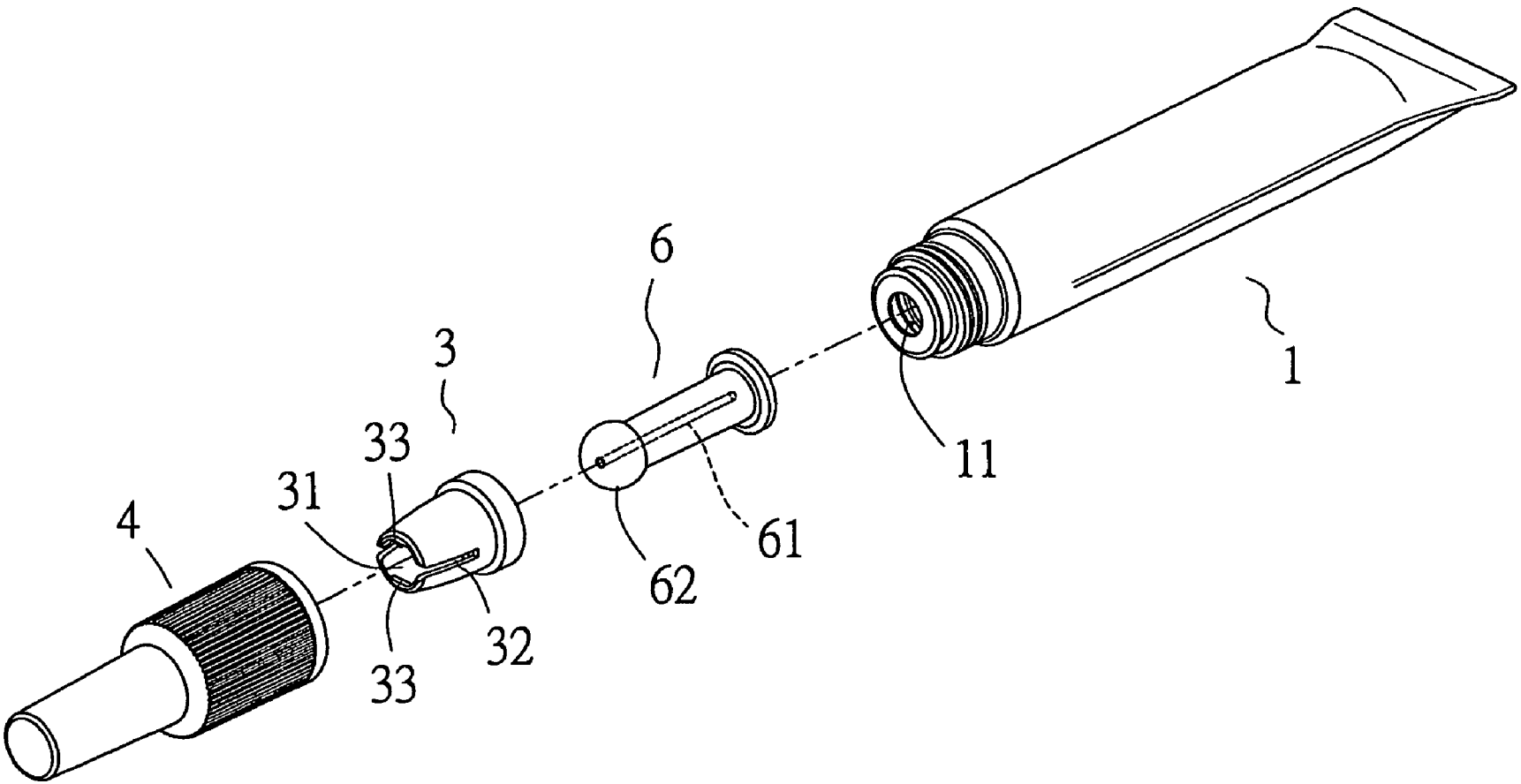
FIG. 6 is a view of third embodiment of the invention.
Figure 7:
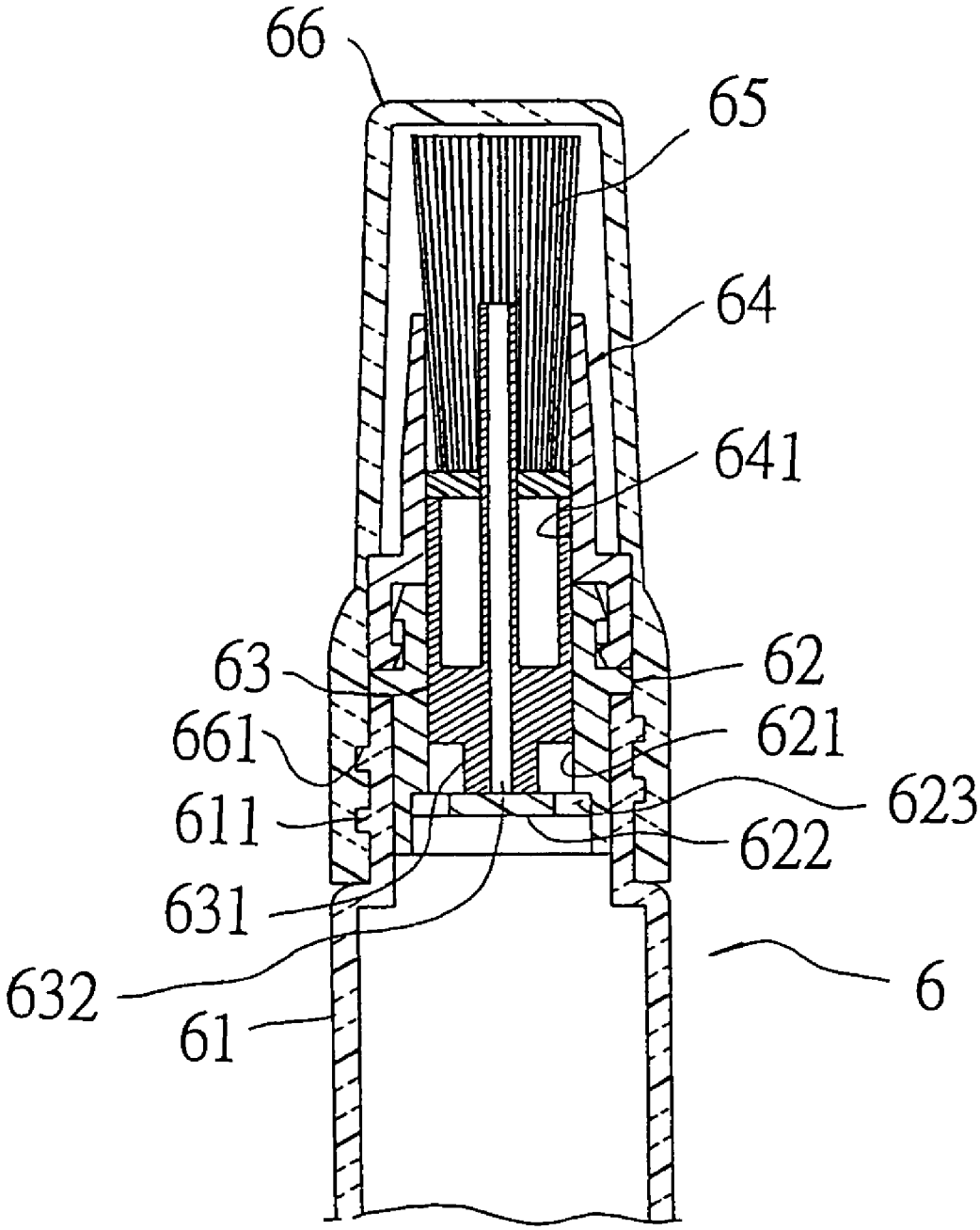
FIG. 7 (PRIOR ART)
FIG. 7 is a sectional view of the prior art.

Still further shown in FIG. 6 is the third preferred embodiment of an applying component 6 of the present invention. The applying component 6 is also made of soft plastic materials, and has a passage 61 for liquid cosmetics, like the above applying component 2. What makes the third applying component 6 different from the first one 2 is an applying portion 62 of the component 6, which is formed as a ball.

From the above description, it can be seen that the present invention has the following advantages:

1. The soft container body allows liquid cosmetics to flow out of it when the cap is separated from the container body. And, the liquid cosmetics are prevented from flowing out when the cap is on the container body. Therefore, the liquid cosmetics container of the present invention is convenient to use.

2. The brushing device of the present invention comprises only the applying component and the clipping component, which can work together with the cap of the cosmetics container to prevent liquid cosmetics from flowing through the passage of the applying component. Therefore, the present invention has a relatively simple structure, and takes relatively little money, time and labor to manufacture and assemble as compared with the prior art.

What is claimed is:

1. An improvement on a brushing device of a container of liquid cosmetics, comprising:

a container body having an opening;

an applying component disposed adjacent the container body;

the applying component being positioned contiguously over the opening of the container body; the applying component being made of soft plastic materials; the applying component having a passage therein for liquid cosmetics to flow through and a detainment recess on an outer surface thereof corresponding to an intermediate portion of the passage; the applying component having an applying portion at a tail thereof, the applying portion being formed around a tail end of the passage;

a clipping component positioned around the applying component and secured to the container body to thereby secure the applying component to the container body; the clipping component having an opening end; the clipping component having a plurality of gaps, which extend through the opening end, so that the opening end is compressible and elastic; the clipping component having two opposing straight clipping portions on an inner side of the opening end thereof which are clipped in the detainment recess formed on the applying component to be in contact therewith; and a threaded cap to cover the opening of the container; the cap having a squeezing portion on an inner side thereof to contact and compress the opening end of the clipping component when the cap is threadedly engaged with the container body, and thereby compress the opening end of the clipping component and block the passage of the applying component, the opening end of the clipping component being uncompressed and the passage of the applying component being unblocked when the threaded cap is separated from the container body.

2. The improvement on a brushing device of a container of liquid cosmetics as claimed in claim 1, wherein the applying component is made of silica gel.

3. The improvement on a brushing device of a container of liquid cosmetics as claimed in claim 1, wherein the applying portion of the applying component is oblique.

4. The improvement on a brushing device of a container of liquid cosmetics as claimed in claim 1, wherein the applying portion of the applying component can be a brush applicator.

5. The improvement on a brushing device of a container of liquid cosmetics as claimed in claim 1, wherein the applying portion of the applying component is formed as a ball.

* * * * *